US006032290A

United States Patent [19]

Lucas et al.

[11] Patent Number: 6,032,290

[45] Date of Patent: Mar. 7, 2000

[54] FINGER NAIL POLISH PROTECTIVE GLOVE

[76] Inventors: Jacqueline A. Lucas; Mark W. Lucas, both of 5085 Marton Rd., Ann Arbor, Mich. 48108-9730

[21] Appl. No.: 09/204,452

[22] Filed: Dec. 3, 1998

[51] Int. Cl.[7] ..... A41D 19/00

[52] U.S. Cl. ..... 2/163; 2/21; 2/159

[58] Field of Search ..... 2/16, 21, 159, 2/160, 161.1, 161.4, 161.6, 162, 163, 170

[56] References Cited

U.S. PATENT DOCUMENTS

| | | | |
|---|---|---|---|
| 1,951,190 | 3/1934 | Gambee | 2/21 |
| 2,580,893 | 1/1952 | Dee | 2/21 |
| 2,591,092 | 4/1952 | Okonski | 2/21 |

*Primary Examiner*—Diana L. Oleksa
*Assistant Examiner*—Katherine Moran

[57] ABSTRACT

A finger nail polish protective glove for protecting the finger nails of a user with freshly applied polish from blemishing while sleeping. The finger nail polish protective glove includes a flexible palm panel has a wrist region and a plurality of flexible digit stalls outwardly extending from the palm panel distal the wrist region of the palm panel. A pair of flexible wrist straps outwardly extending from opposite sides of the palm panel. The free ends of the wrist straps are coupled together. Each of the digit stalls has a protective cage pivotally coupled to the tip of the respective digit stall. Each of the protective cages covers a portion of the associated digit stall adjacent the tip of the associated digit stall having a length less than about one-half of a distance of the associated finger stall defined between the root and tip of the associated finger stall.

11 Claims, 3 Drawing Sheets

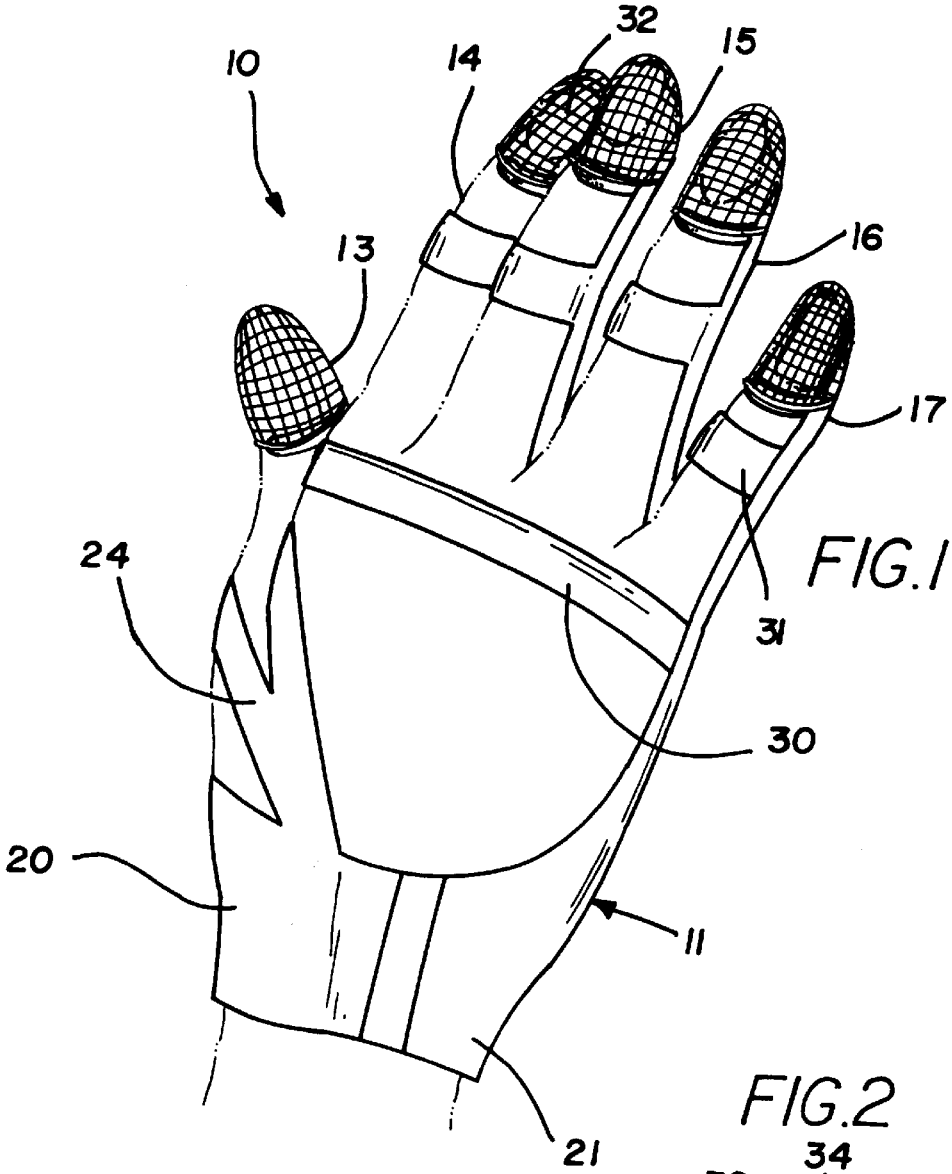
FIG.1
FIG.2
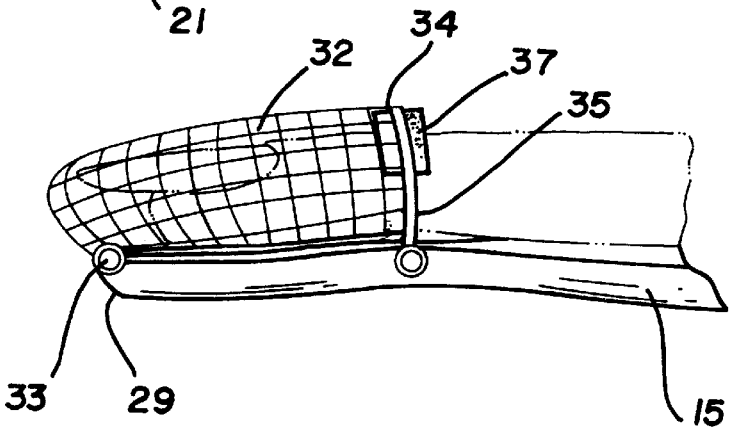

FINGER NAIL POLISH PROTECTIVE GLOVE

BACKGROUND OF THE INVENTION

1. Field of the Invention

The present invention relates to devices for protecting finger nail polish and more particularly pertains to a new finger nail polish protective glove for protecting the finger nails of a user with freshly applied polish from blemishing while sleeping.

1. Description of the Prior Art

The use of devices for protecting finger nail polish is known in the prior art. More specifically, devices for protecting finger nail polish heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,386,104 by Casey; U.S. Pat. No. 5,186,189 by Harris; U.S. Pat. No. 5,548,844 by Ceresia; U.S. Pat. No. Des. 386,352 by Torres; U.S. Pat. No. 2,056,555 by Auster et al.; and U.S. Pat. No. 5,581,811 by Cohen et al.

While these devices fulfill their respective, particular objectives and requirements, the aforementioned patents do not disclose a new finger nail polish protective glove. The inventive device includes a flexible palm panel, has a wrist region and a plurality of flexible digit stalls outwardly extending from the palm panel distal the wrist region of the palm panel. A pair of flexible wrist straps outwardly extending from opposite sides of the palm panel. The free ends of the wrist straps are coupled together. Each of the digit stalls has a protective cage pivotally coupled to the tip of the respective digit stall. Each of the protective cages covers a portion of the associated digit stall adjacent the tip of the associated digit stall having a length less than about one-half of a distance of the associated finger stall defined between the root and tip of the associated finger stall.

In these respects, the finger nail polish protective glove according to the present invention substantially departs from the conventional concepts and designs of the prior art, and in so doing provides an apparatus primarily developed for the purpose of protecting the finger nails of a user with freshly applied polish from blemishing while sleeping.

SUMMARY OF THE INVENTION

In view of the foregoing disadvantages inherent in the known types of devices for protecting finger nail polish now present in the prior art, the present invention provides a new finger nail polish protective glove construction wherein the same can be utilized for protecting the finger nails of a user with freshly applied polish from blemishing while sleeping.

The general purpose of the present invention, which will be described subsequently in greater detail, is to provide a new finger nail polish protective glove apparatus and method which has many of the advantages of the devices for protecting finger nail polish mentioned heretofore and many novel features that result in a new finger nail polish protective glove which is not anticipated, rendered obvious, suggested, or even implied by any of the prior art devices for protecting finger nail polish, either alone or in any combination thereof.

To attain this, the present invention generally comprises a flexible palm panel and has a wrist region and a plurality of flexible digit stalls outwardly extending from the palm panel distal the wrist region of the palm panel. A pair of flexible wrist straps outwardly extending from opposite sides of the palm panel. The free ends of the wrist straps are coupled together. Each of the digit stalls has a protective cage pivotally coupled to the tip of the respective digit stall. Each of the protective cages covers a portion of the associated digit stall adjacent the tip of the associated digit stall having a length less than about one-half of a distance of the associated finger stall defined between the root and tip of the associated finger stall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new finger nail polish protective glove apparatus and method which has many of the advantages of the devices for protecting finger nail polish mentioned heretofore and many novel features that result in a new finger nail polish protective glove which is not anticipated, rendered obvious, suggested, or even implied by any of the prior art devices for protecting finger nail polish, either alone or in any combination thereof.

It is another object of the present invention to provide a new finger nail polish protective glove which may be easily and efficiently manufactured and marketed.

It is a further object of the present invention to provide a new finger nail polish protective glove which is of a durable and reliable construction.

An even further object of the present invention is to provide a new finger nail polish protective glove which is susceptible of a low cost of manufacture with regard to both materials and labor, and which accordingly is then susceptible of low prices of sale to the consuming public, thereby making such finger nail polish protective glove economically available to the buying public.

Still yet another object of the present invention is to provide a new finger nail polish protective glove which provides in the apparatuses and methods of the prior art some of the advantages thereof, while simultaneously overcoming some of the disadvantages normally associated therewith.

Still another object of the present invention is to provide a new finger nail polish protective glove for protecting the finger nails of a user with freshly applied polish from blemishing while sleeping.

Yet another object of the present invention is to provide a new finger nail polish protective glove which includes a flexible palm panel has a wrist region and a plurality of flexible digit stalls outwardly extending from the palm panel distal the wrist region of the palm panel. A pair of flexible wrist straps outwardly extending from opposite sides of the palm panel. The free ends of the wrist straps are coupled together. Each of the digit stalls has a protective cage pivotally coupled to the tip of the respective digit stall. Each of the protective cages covers a portion of the associated digit stall adjacent the tip of the associated digit stall having a length less than about one-half of a distance of the associated finger stall defined between the root and tip of the associated finger stall.

Still yet another object of the present invention is to provide a new finger nail polish protective glove that lets a user go to sleep after applying nail polish to their finger nails before the nail polish has completely dried without risking ruining the polish job from contact with the bed linen.

Even still another object of the present invention is to provide a new finger nail polish protective glove that may also be used to protect the finger nail polish when performing various tasks and chores without risking damage to the polish job while completing the task.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new finger nail polish protective glove in use on a hand of a user according to the present invention.

FIG. 2 is a schematic side view of the region around the tip of a digit stall of the present invention.

DESCRIPTION OF THE PREFERRED EMBODIMENT

Figure 3:
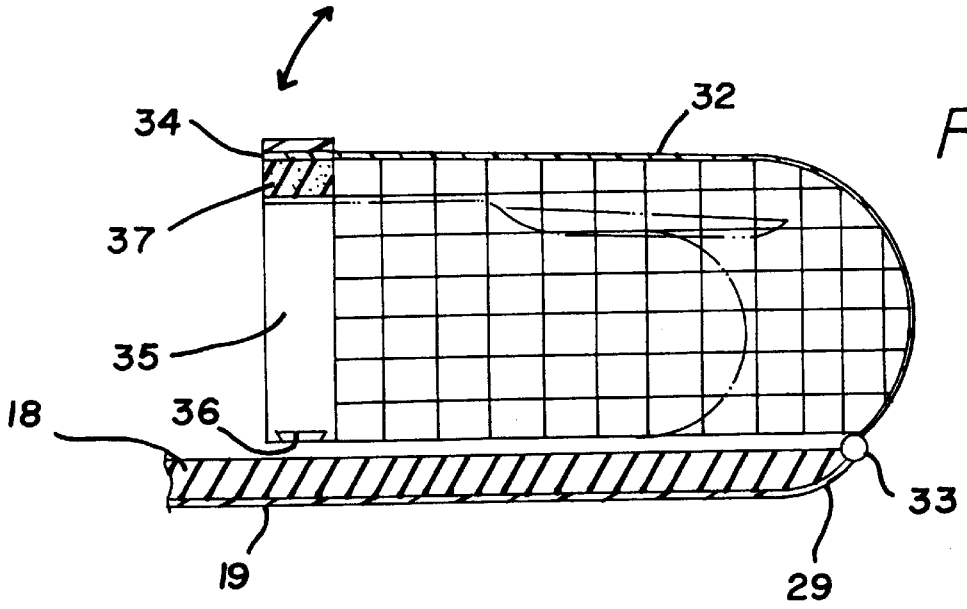
FIG. 3 is a schematic cross sectional view of the region around the tip of a digit stall of the present invention.
Figure 4:
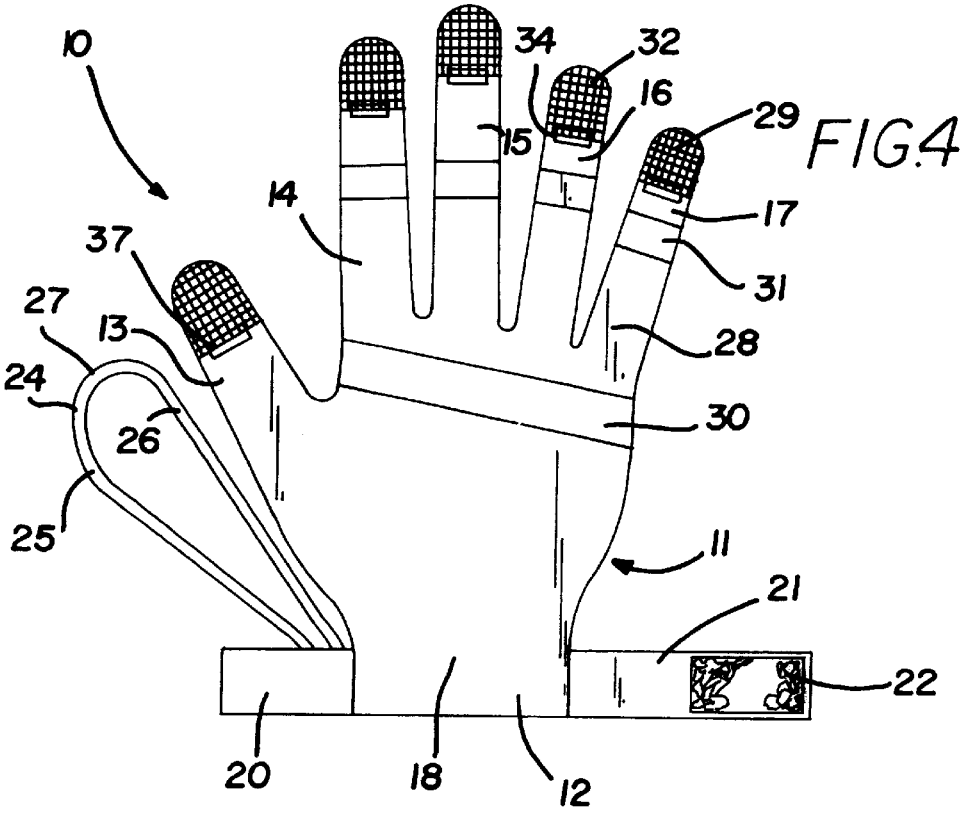
FIG. 4 is a schematic back view of the present invention.
Figure 5:
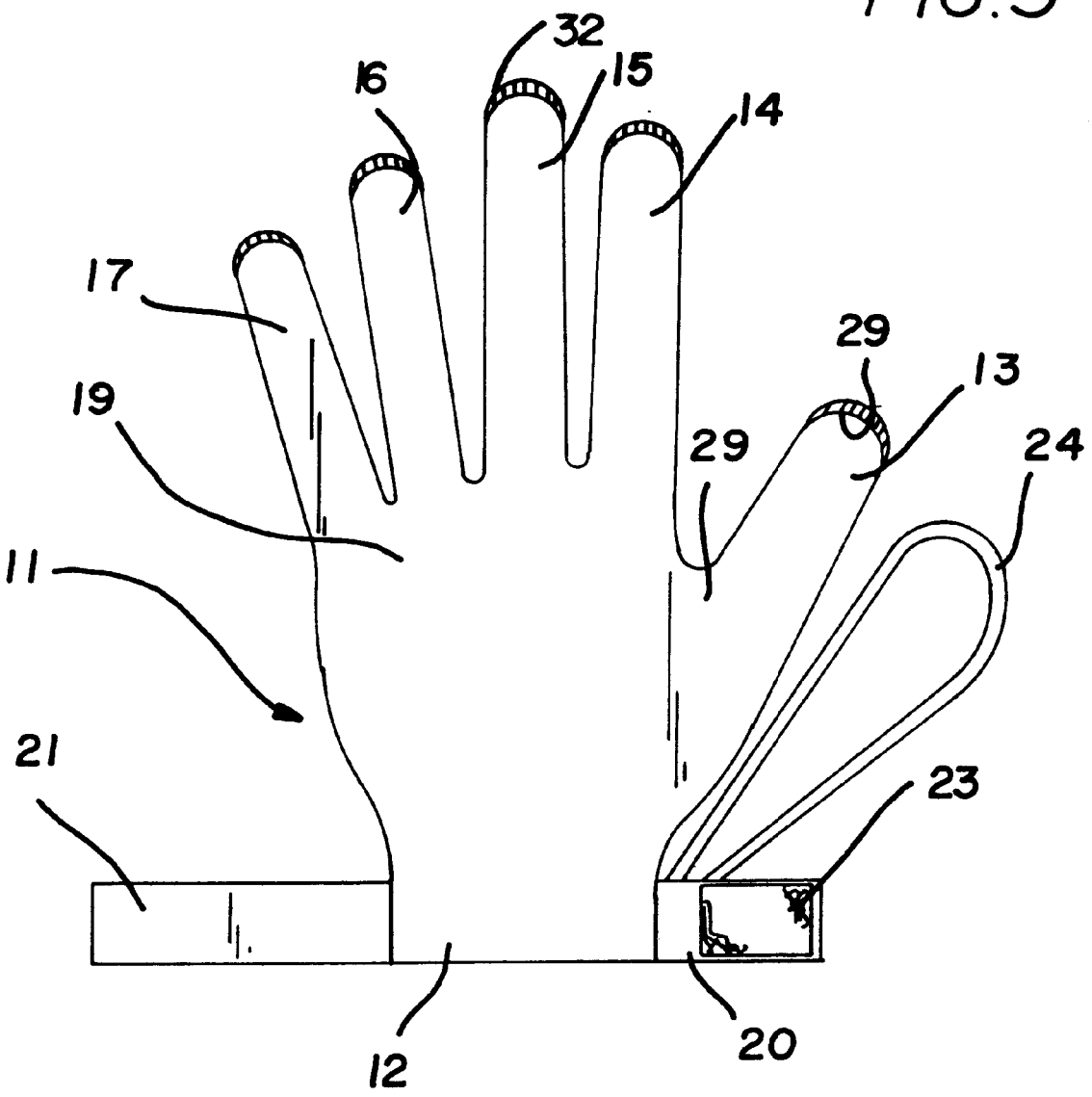
FIG. 5 is a schematic front view of the present invention.

With reference now to the drawings, and in particular to FIGS. 1 through 5 thereof, a new finger nail polish protective glove embodying the principles and concepts of the present invention and generally designated by the reference numeral 10 will be described.

As best illustrated in FIGS. 1 through 5, the finger nail polish protective glove 10 generally comprises a flexible palm panel and has a wrist region and a plurality of flexible digit stalls outwardly extending from the palm panel distal the wrist region of the palm panel. A pair of flexible wrist straps outwardly extending from opposite sides of the palm panel. The free ends of the wrist straps are coupled together. Each of the digit stalls has a protective cage pivotally coupled to the tip of the respective digit stall. Each of the protective cages covers a portion of the associated digit stall adjacent the tip of the associated digit stall having a length less than about one-half of a distance of the associated finger stall defined between the root and tip of the associated finger stall.

In use, the protective glove 10 is designed for protecting the polish on the fingernails of the hand of the user from blemishing from accidental contact from objects when performing various tasks including sleeping. Specifically, the protective glove 10 includes a flexible palm panel 11 shaped to conform to a palm of a user and having a wrist region 12. A plurality of flexible digit stalls 13,14,15,16,17 outwardly extending from the palm panel distal the wrist region of the palm panel. As illustrated in FIG. 3, the palm panel and the digit stalls each preferably comprise substantially coextensive flexible inner and outer layers 18,19. The inner layers of the digit stalls each are continuous with the inner layer of the palm panel and the outer layers of the digit stalls each are continuous with the outer layer of the palm panel. The inner layers each comprise a resiliently deformable material, and ideally, a resiliently deformable foamed material (such as a sponge material). The outer layers each comprise a substantially water-impermeable material (such as a flexible soft plastic) to substantially block passage of water through the outer layers.

In use, the palm panel is designed for positioning adjacent a palm of a hand of a user so that the wrist region of the palm panel is positioned adjacent a wrist of the user. A pair of flexible wrist straps 20,21 outwardly extend from opposite sides of the palm panel. Each of the wrist straps terminates at a free end which are coupled together. In use, the wrist straps is designed for wrapping around the wrist of the user to secure the palm panel to the wrist of the user as shown in FIG. 1. Preferably, a hook and loop fastener detachable couples the free ends of the wrist straps together. The hook and loop fastener has a pair of complementarily attachable portions 22,23. Each of the complementary attachable portions is provided on an associated wrist strap adjacent the free end of the associated wrist strap. Preferably, each of the wrist straps comprises an elastic material to permit stretching of the wrist straps around the wrist of the user to tightly secure the wrist straps to the wrist of the user.

Preferably, a flexible thumb loop 24 is coupled to one of the wrist straps. In use, the thumb loop is designed for extending around a thumb of a hand of a user positioned adjacent the thumb stall. The thumb loop preferably comprises an elastic material to permit stretching of the thumb loop around the thumb of the user to help hold the palm panel in place on the palm of the hand of the user. As shown in the Figures, the thumb loop has a pair of elongate arm portions 25,26 and an arcuate cross portion 27 connecting the arm portions of the thumb loop together distal the wrist straps. The arm portions of the thumb loop are coupled to the one wrist strap to couple the thumb loop to the one wrist strap.

The plurality of digit stalls include a thumb stall 13 and a plurality of finger stalls 14,15,16,17 each designed for positioning adjacent an associated digit thumb or finger of a hand of a user. The thumb stall is outwardly extended from a side of the palm panel. Each of the digit stalls has a root 28 and a tip 29, and longitudinal axis extending between the root and tip of the respective digit stall. The roots of the digit stalls are positioned adjacent the palm panel. Each of the digit stalls preferably has a length defined between the root and tip of the respective digit stall designed for fitting the associated digit of the hand of the user.

An elongate flexible upper hand strap 30 is extended across the sides of the palm panel between the finger stalls and positioned adjacent the roots of the finger stalls. The upper hand strap has a pair of opposite ends coupled to the palm panel. One of the ends of the upper hand strap is positioned adjacent one side of the palm panel and the other of the ends of the upper hand strap is positioned adjacent the other side of the palm panel. In use, the upper hand strap is designed for extending over the back of the hand of the user adjacent the roots of the fingers of the hand of the user to hold the hand of the user to the palm panel. The upper hand strap preferably comprises an elastic material to permit stretching of the upper hand strap along its length between the ends of the upper hand strap to help hold the palm panel in place on the palm of the hand of the user.

Each of the finger stalls has a finger strap 31 coupled thereto. The finger straps are positioned towards and spaced apart from the root of the respective finger stall. In use, the finger straps are designed for looping around the associated finger of the hand of the user positioned adjacent the respective finger stall. Each of the finger straps is positioned from the associated root of the respective finger stall between about one-half and about one-third of a length of the respective finger stall defined between the root and tip of the respective finger stall so that the finger straps cover the lower knuckle of the respective finger of the user to hold the fingers of the user to their associated finger stalls. The finger straps each preferably comprises an elastic material to permit stretching of the finger straps to help hold the fingers of the user to their associated finger stall.

Each of the digit stalls has a protective cage 32 pivotally coupled to the associated tip of the respective digit stall by a pivot hinge 33 to permit pivoting of each protective cage between a closed position over the associated digit stall and an open position pivoted away from the associated digit stall. Each of the protective cages covers a portion of the associated digit stall adjacent the tip of the associated digit stall has a length along the longitudinal axis of the associated digit stall less than about one half a length of the associated finger stall defined between the root and tip of the associated finger stall. Ideally, each of the protective cages covers between about one-half and about one-third the length of the associated finger stall adjacent the tip of the associated finger stall. In use, each of the protective cages is designed for covering a finger nail and finger tip of the digit of the hand of the user associated with the respective digit stall to protect nail polish on the finger nails, especially not quite dry nail polish, from damage and blemishing.

Each of the protective cages has a plurality of apertures therethrough to permit passage of air therethrough to aid drying and ventilation of the nail polish on the finger nails of the user. Ideally, the protective cages each comprise a rigid mesh such as a rigid plastic mesh. Each of the protective cages has an arcuate back edge 34 distal the tip of the associated digit stall. The arcuate back edges of the protective cages each have a concavity facing the associated digit stall when the respective protective cage is positioned in a closed position over the associated finger stall to cover the associated user's finger nail. Each of the protective cages has a generally C-shaped clip 35 along the back edge of the respective cage. Each of the clips has a pair of opposite ends detachably attached to the associated digit stall. Preferably, the ends of the clips each have a resilient tang 36 engaging a side portion of the associated digit stall to detachably attach the ends of respective clip to the associated digit stall.

In a preferred embodiment, each of the protective cages has a resiliently compressible pad 37 such as a sponge pad coupled to the concavity of the arcuate back edge of the respective protective cage. In use, the pads of the protective cages are designed for pressing against the digit of the user's hand protected by the respective protective cage to help hold the digits of the user in position in the protective cages so that the nails of the user's digit do not come into contact with the inside of the protective cage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A protective glove, comprising:

a flexible palm panel having a wrist region;

a plurality of flexible digit stalls outwardly extending from said palm panel distal said wrist region of said palm panel;

each of said digit stalls having a root and a tip, said roots of said digit stalls being positioned adjacent said palm panel;

a pair of flexible wrist straps outwardly extending from opposite sides of said palm panel;

each of said wrist straps terminating at a free end;

said free ends of said wrist straps being coupled together;

each of said digit stalls having a protective cage pivotally coupled to the associated tip of the respective digit stall; and each of said protective cages covering a portion of the associated digit stall adjacent the tip of the associated digit stall having a length along the associated digit stall less than about one-half of a distance of the associated finger stall defined between the root and tip of the associated finger stall.

2. The protective glove of claim 1, wherein said palm panel and said digit stalls each comprises substantially coextensive flexible inner and outer layers, wherein said inner layers each comprise a resiliently deformable material, wherein said outer layers each comprise a substantially water-impermeable material to substantially block passage of water through said outer layers.

3. The protective glove of claim 2, wherein said inner layers of said digit stalls each are continuous with said inner layer of said palm panel, and said outer layers of said digit stalls each are continuous with said outer layer of said palm panel.

4. The protective glove of claim 1, wherein a hook and loop fastener detachably couples said free ends of said wrist straps together.

5. The protective glove of claim 1, further comprising a flexible thumb loop being coupled to one of said wrist strap.

6. The protective glove of claim 1, wherein said plurality of digit stalls includes a plurality of finger stalls and a thumb stall, said thumb stall being outwardly extended from one of said sides of said palm panel, wherein an elongate flexible upper hand strap is extended across said sides of said palm panel between said finger stalls, said upper hand strap being positioned adjacent said roots of said finger stalls.

7. The protective glove of claim 6, wherein each of said finger stalls has a finger strap coupled thereto, said finger straps being positioned towards and spaced apart from said root of the respective finger stall.

8. The protective glove of claim 7, wherein each of said finger straps is positioned from the associated root of the respective finger stall between about one-half and about one-third of a distance of the respective finger stall defined between the root and tip of the respective finger stall.

9. The protective glove of claim 1, wherein each of said protective cages has a plurality of apertures therethrough to permit passage of air therethrough.

10. The protective glove of claim 9, wherein said protective cages each comprise a rigid mesh.

11. A protective glove, comprising:

a flexible palm panel shaped to conform to a palm of a user and having a wrist region;

a plurality of flexible digit stalls outwardly extending from said palm panel distal said wrist region of said palm panel;

said palm panel and said digit stalls each comprising substantially coextensive flexible inner and outer layers, said inner layers of said digit stalls each being continuous with said inner layer of said palm panel, said outer layers of said digit stalls each being continuous with said outer layer of said palm panel;

said inner layers comprising a resiliently deformable material, wherein said inner layers comprise a foamed material;

said outer layers comprising a substantially water-impermeable material to substantially block passage of water through said outer layers;

said palm panel being adapted for positioning adjacent a palm of a hand of a user such that said wrist region of said palm panel is positioned adjacent a wrist of the user;

a pair of flexible wrist straps outwardly extending from opposite sides of said palm panel;

each of said wrist straps terminating at a free end;

said free ends of said wrist straps being coupled together;

wherein a hook and loop fastener detachably couples said free ends of said wrist straps together;

each of said wrist straps comprising an elastic material;

a flexible thumb loop being coupled to one of said wrist strap, said thumb loop being adapted for extending around a thumb of a hand of a user, said thumb loop comprising an elastic material;

said thumb loop having a pair of elongate arm portions and an arcuate cross portion connecting said arm portions of said thumb loop together, said arm portions of said thumb loop being coupled to said one wrist strap to couple said thumb loop to said one wrist strap;

said plurality of digit stalls including a plurality of finger stalls and a thumb stall each adapted for positioning adjacent an associated digit of a hand of a user;

said thumb stall being outwardly extended from a side of said palm panel;

each of said digit stalls having a root and a tip, and longitudinal axis extending between said root and tip of the respective digit stall, said roots of said digit stalls being positioned adjacent said palm panel;

each of said digit stalls having a length defined between said root and tip of the respective digit stall;

an elongate flexible upper hand strap being extended across said sides of said palm panel between said finger stalls, said upper hand strap being positioned adjacent said roots of said finger stalls;

upper hand strap having a pair of opposite ends coupled to said palm panel, one of said ends of said upper hand strap being positioned adjacent one side of said palm panel and the other of said ends of said upper hand strap being positioned adjacent the other side of said palm panel;

said upper hand strap comprising an elastic material;

each of said finger stalls having a finger strap coupled thereto, said finger straps being positioned towards and spaced apart from said root of the respective finger stall;

each of said finger straps being positioned from the associated root of the respective finger stall between about one-half and about one-third of a length of the respective finger stall defined between the root and tip of the respective finger stall;

said finger straps each comprising an elastic material;

each of said digit stalls having a protective cage pivotally coupled to the associated tip of the respective digit stall;

each of said protective cages covering a portion of the associated digit stall adjacent the tip of the associated digit stall having a length along the longitudinal axis of the associated digit stall less than about one half a length of the associated finger stall defined between the root and tip of the associated finger stall;

each of said protective cages having a plurality of apertures therethrough to permit passage of air therethrough;

wherein said protective cages each comprise a rigid mesh;

each of said protective cages having an arcuate back edge distal said tip of the associated digit stall, said arcuate back edges of said protective cages each having a concavity facing the associated digit stall;

each of said protective cages having a generally C-shaped clip along said back edge of the respective cage, each of said clips having a pair of opposite ends detachably attached to the associated digit stall; and each of said protective cages having a resiliently compressible pad coupled to said concavity of said arcuate back edge of the respective protective cage.

* * * * *